US005291694A

United States Patent [19]

Hosoya et al.

[11] Patent Number: 5,291,694

[45] Date of Patent: Mar. 8, 1994

[54] APPARATUS AND METHOD OF WORKING AND FINISH TREATING A STONE SURFACE

[75] Inventors: Fukutoshi Hosoya; Nobuo Nakano, both of Tokyo, Japan

[73] Assignee: JSE Corporation, Tokyo, Japan

[21] Appl. No.: 885,595

[22] Filed: May 19, 1992

[30] Foreign Application Priority Data

Jun. 3, 1991 [JP] Japan ..... 3-131286

[51] Int. Cl.[5] ..... B24B 1/00

[52] U.S. Cl. ..... 51/317; 51/319; 51/323; 51/439

[58] Field of Search ..... 51/317, 319, 320, 321, 51/323, 417, 418, 410, 439; 125/2, 25, 26; 83/53, 177

[56] References Cited

U.S. PATENT DOCUMENTS

| | | | |
|---|---|---|---|
| 1,919,027 | 1/1932 | Klotzman . | |
| 2,015,875 | 10/1955 | Sloan | 51/321 |
| 2,755,598 | 7/1956 | Van Denburgh | 51/439 |
| 2,990,653 | 7/1961 | Browning | 51/321 |
| 3,427,763 | 2/1969 | Maasberg et al. | 51/321 |
| 3,553,895 | 1/1971 | Power | 51/321 |
| 3,709,436 | 1/1973 | Foster . | |
| 4,184,638 | 1/1980 | Ogasawara et al. . | |
| 4,307,840 | 12/1981 | Schulze et al. . | |
| 4,369,850 | 1/1983 | Barker . | |
| 4,424,769 | 1/1984 | Charamathieu et al. . | |
| 4,452,183 | 6/1984 | Yazidjian . | |
| 4,744,517 | 5/1988 | Iwamoto et al. . | |
| 4,806,172 | 2/1989 | Adaci et al. | 134/34 |
| 4,897,969 | 2/1990 | Balhorn | 51/418 |

FOREIGN PATENT DOCUMENTS

| | | |
|---|---|---|
| 3027989D | 9/1989 | Australia . |
| 400210 | 1/1934 | Belgium . |
| 0422610A3 | 4/1991 | European Pat. Off. . |
| 3032191A1 | 4/1982 | Fed. Rep. of Germany . |
| 3234419A1 | 3/1984 | Fed. Rep. of Germany . |
| 8709676U1 | 10/1987 | Fed. Rep. of Germany . |
| 3702313C1 | 4/1988 | Fed. Rep. of Germany . |
| 2420996 | 10/1979 | France . |
| 60-108271 | 6/1985 | Japan . |
| 61-229000 | 10/1986 | Japan . |
| 4-81136 | 4/1991 | Japan . |
| 3-254908 | 11/1991 | Japan . |
| 567907 | 10/1975 | Switzerland . |

OTHER PUBLICATIONS

Sekibunsha, "Think Scientifically of Stone Working," pp. 42–55.

*Primary Examiner*—. Rachuba

*Attorney, Agent, or Firm*—Lowe, Price, LeBlanc & Becker

[57] ABSTRACT

Apparatus and a method are provided for working and finish-treating the surfaces of stones by jetting a flow consisting solely of water, at a pressure of 200 kg/cm$^2$ or more, toward the stone surface which previously may have been cut by a gang saw or a circular saw cutting machine, bush hammered or dabbed finished, bush hammered and then dabbed finished, bush hammered and then flamed or directly flamed without being bush hammered so that the surface of the stones is roughed and crystal particles in the stones are exposed.

6 Claims, 13 Drawing Sheets

APPARATUS AND METHOD OF WORKING AND FINISH TREATING A STONE SURFACE

BACKGROUND OF THE INVENTION (a) Field of the Invention

The present invention relates to a method of working and finish treating the surface of stones, preferably granite, for roughing the surface and for removing the gangue formed thereon in prior cutting and treatment steps.

(b) Related Art

A large quantity of various stones have been recently used to provide high grade buildings and to give depth impression. Demands for granite and marble are particularly high.

However, methods of working the stone surface are conventional. They are described in a literature "Think scientifically of stone working" published by Sekibunsha, pages 42 to 55.

Three conventional stone working methods 1 to 3 will be briefly described with reference to FIG. 22. Each of the methods 1 to 3 comprises the steps as follows.

1. Rubble, hump removing, chiseling finishing, bush hammering, (flame finishing), dabbed finished, grinding, honing and polishing 2. Rubble, cutting by a gang saw, bush hammering, (flame finishing), dabbed finishing, grinding, honing and polishing 3. Rubble, cutting by a circular saw cutting machine, honing, polishing, or bush hammering, (flame finishing), dabbed finishing, polishing In this case, the flame finishing may be omitted The bush hammering may be omitted and the dabbed hammering may be directly performed.

The stones which have been subjected to the process proceeded to the step of polishing are mainly used as outer wall material requiring gloss. If gloss is not required, the stones subjected to the process which is terminated, for example, in step of bush or dabbed hammering before the step of polishing are practically used.

Particularly, if the stones are used as stepping-stones, the stones which have not reached the step of polishing are directly used for preventing pedestrian from slipping.

Since the process 1 requires a number of steps and high labor cost, the process 2 or 3 are most adopted.

Observation of such mechanically cut surface shows that the crystal particle groups p, p, . . . are flat on the surface as shown in FIG. 1 since they are sliced. Observation in more detail shows that small concaves and convexes and cracks are often formed as shown in FIG. 2 due to application of an external force. Many scratch stripes are formed by slicing. Accordingly, the cut stone looks very whitish on the surface thereof unlike untreated natural stone. Therefore, a working process proceeded to the polishing step after the above mentioned bush hammering or the dabbed hammering on one side of a stone panel is essential since the just cut stone has little commercial value. However, this polishing step requires much labor, resulting in a high manufacturing cost. The other side is unworked since it is not related with the appearance.

Although the above mentioned flame finishing may be performed to provide the mechanically cut surface with concaves and convexes, the problem of the whitish looking surface can be overcome to same extent. However, slightly whitish looking surface remains and the condition of natural stone can not be reproduced. The stone is heated to a high temperature by the flame finishing so that the thermal stress is very high. Therefore, the panel which is subjected to flame finishing should be 8 mm or more, at least 5 mm in thickness in order to prevent damages due to the thermal stress. Accordingly, the amount of stone per application area will be inevitably increased.

SUMMARY OF THE INVENTION

It is, therefore, an object of the present invention to provide a stone working and treating method and apparatus which is capable of providing stones reproducing the condition of natural stone and having excellent and concave and convex appearance and which is enough suitable for walking thereon and giving us depth impression and is remarkably less in working and treating cost.

In order to accomplish the above mentioned object, the present invention in a preferred embodiment provides a method of working and finish-treating a surface of a stone that has been subjected to at least one previous treatment selected from a group of treatments consisting of gang saw cutting, circular saw cutting, bush hammering, dab finishing, and flaming. The method includes jetting a flow consisting solely of pressurized water directed at the previously treated stone surface, at a pressure not less than 200 kg/cm$^2$, through a plurality of nozzles generating jets that respectively overlap adjacent jets. The nozzles are rotated about a first axis to produce corresponding rotation of respective jets therefrom. The previously treated stone surface is translated relative to the rotating jets at a predetermined spacing therefrom, e.g., by moving the stone under the jets. The jetted flow thereby removes gangue from the previously treated surface, to leave a finished stone surface which is close to a natural stone surface.

In this case, panel-like stones having said surface are conveyed along a conveying path and treating liquid jetting means is disposed so that it faces to said conveying path for jetting said treating liquid toward said surface.

The present invention in another preferred embodiment further provides an apparatus for working and finish-treating a surface of a stone that has been subjected to at least one previous treatment selected from a group of treatments consisting of gang saw cutting, circular saw cutting, bush hammering, dab finishing, and flaming. The apparatus has a plurality of nozzles rotatable about a first axis to provide corresponding rotation of respective overlapping jets flowed from said nozzles. It also has means for providing a pressurized flow consisting solely of water to the plurality of nozzles, at a pressure not less than 200 kg/cm$^2$, to thereby provide a plurality of overlapping rotating jets of said pressurized water. Means are provided for translating the previously treated stone surface relative to the rotating overlapping jets at a predetermined spacing therefrom, to apply said jets of pressurized water uniformly over said previously treated stone surface.

When the crystal particles in the vicinity of the surface which have reduced the bonding areas with the other crystal particles or the bonding power in the crystal grain boundary with the other crystal particles by the previous mechanical working are subjected to pressurized treating liquid jet on the surface thereof, some of the particles are separated by the energy of the treating liquid as shown in FIG. 3. As a result of this, the surface is roughed. The remained surface particles will not be separated when the stone will be used as stepping-stone since they have a higher power of bonding with the lower crystal particles. The particles which have originally remained on the surface of the stone may be partially separated from the stone when the crack causes cleavage. This results in a round stone as a whole.

On the other hand, glittering crystals of mica are observed on the surface of, for example, the granite which has been worked and treated in accordance with the present invention. These mica crystals are never found when the stone is subjected to mechanical working or flame finishing. It is deemed that the reasons reside in that in the other treating methods such as mechanical working, the stone is ground to make the crystal on the surface coarse, particle fragments which have not been ground remain on the surface of the mica crystal or the mica crystals per se are partially ground or form mark while treatment of a stone with a treating liquid jet in accordance with the present invention causes the crystal particles to cleave in the grain boundaries so that crystal particles are removed. Since the flame finishing breaks particles due to thermal stress to make the particles coarse, the particles in the surface area are deformed due to thermal stress and are in a state different from the natural crystal state. It is said that the polished stone surface state is close to the natural stone surface state. Comparison of the polished stone with the flamed stone shows that the latter stone looks more whitish than the former stone and has a color different from that of the former stone. In contrast to this, a stone which has been treated in accordance with present invention exhibits the state close to the state of the natural stone rather than the polished stone.

The present invention enables a high speed treatment and automation. Accordingly, cost in working and treatment is remarkably reduced.

Since natural crystal surface appears by the above mentioned treatment in accordance with the present invention, the appearance of the treated stone is remarkably excellent and never looks whitish. Roughness is formed and crystals having a low bonding power are removed by the treatement so that only crystal particles having a high bonding power remain on the surface of the stone. If the stone is used as a stepping-stone, it is excellent in durability and easiness of walking thereon.

DESCRIPTION OF THE EMBODIMENTS

The present invention will be described with reference to drawings.

The method of the present invention is applied to the surface which is cut by the above mentioned process 2 by a stone gang saw or the surface which is cut by the process 3 by a circular saw cutting machine. Method of the present invention can directly treat these cut surfaces. The method of the present invention can also treat the bush hammered cut surface, the dabbed finished cut surface, the bush hammered and dabbed finished cut surface, the bush hammered and flame finished surface or the surface which is directly flame finished without being dabbed finished.

The phase at which the treatment of the present invention should begin can be appropriately selected depending upon the stone to be treated, the desired roughness of the surface or the uses.

A treating liquid is jetted toward these surfaces at a pressure of 200 kg/cm$^2$ or more so that the surfaces are roughed and the crystal particles are exposed. If the pressure is less than 200 kg/cm$^2$, the resultant roughness is not sufficient. The pressure is preferably 500 kg/cm or higher, more preferably 800 kg/cm or higher. It is generally preferable that water is used as the treating liquid in view of economy. A slurry liquid containing grinding powers may be used. However, this slurry liquid is not very preferable since it may cause fine flaws on the surfaces of crystal particles so that the treated stone becomes whitish on the surface thereof. Acidic or alkaline liquids may often etch the stones. As a result, water is most preferable. Addition of a high-molecular thickening agent enhances treating properties. Description will be made with reference to water used as a treating liquid.

On the other hand, the stone is not specifically limited and may include granites, andesites, sandstones, clay slates, tuffs, marbles or sepentines. Application of the inventive method to marbles, in particular to granites is effective. The granites include white granite and red granite. If the present invention is applied to the red granite, the effect of the present invention is apparent in resultant whitish surface or the surface condition of the crystal particles in comparison with conventional working method.

If high pressurized water is jetted upon a target surface, it is convenient to use a jetting nozzle. Use of a plurality of jetting nozzles is more excellent in treating speed than case of single jetting nozzle as high pressurized water jetting means. If working lines are disposed in parallel with each other by the single or the plurality of jetting nozzles, strips are formed on the treated surface along the working lines, resulting in a poor appearance. Accordingly, it is preferable to use an apparatus which is proposed in Japanese Unexamined Patent Publication Sho 61-229000 filed by the present assignee.

Figure 1:
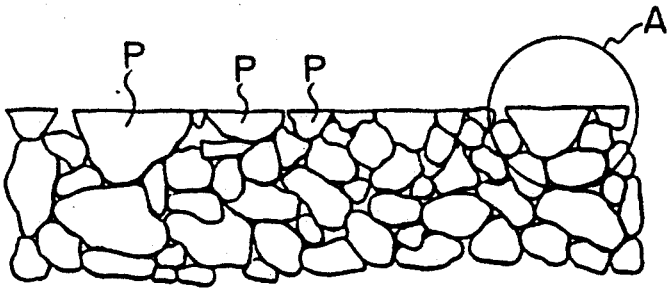
FIG. 1 is a schematic sectional view showing the condition of a machine worked surface.
Figure 2:
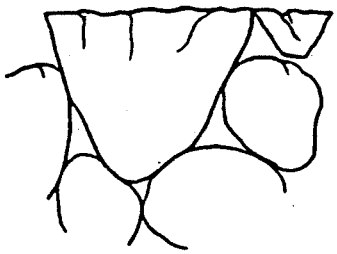
FIG. 2 is an enlarged schematic sectional view showing a part A of the machine worked surface of FIG. 1.
Figure 3:
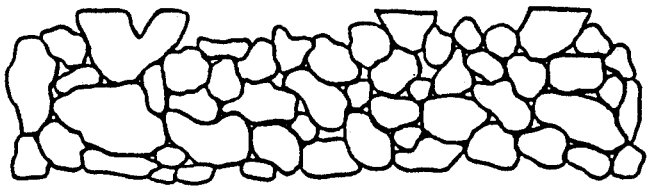
FIG. 3 is a schematic sectional view showing the surface which has been treated in accordance with the present invention.
Figure 4:
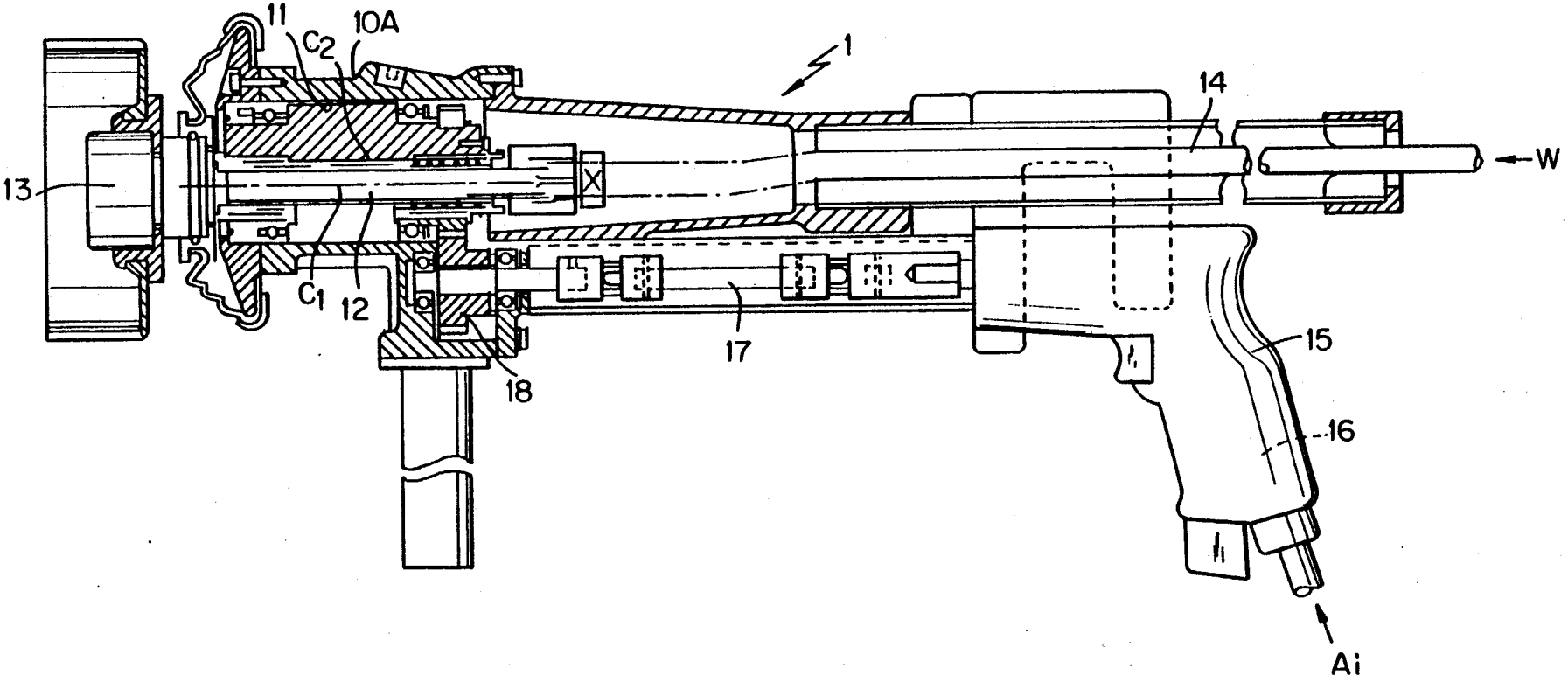
FIG. 4 is a sectional view showing an jet gun which is suitable for the treatment of the present invention.
Figure 5:
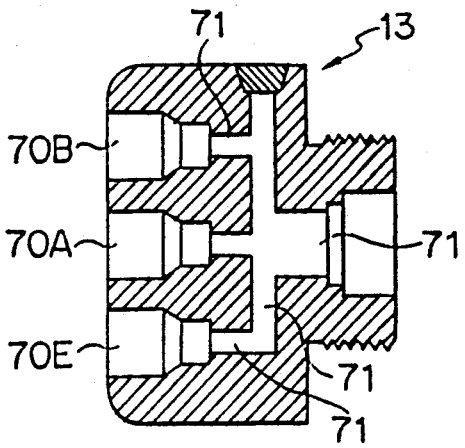
FIG. 5 is a longitudinal sectional view showing a jet gun.
Figure 6:
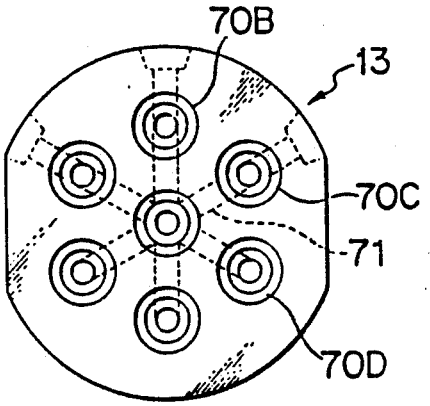
FIG. 6 is a front view showing the jet gun.
Figure 7:
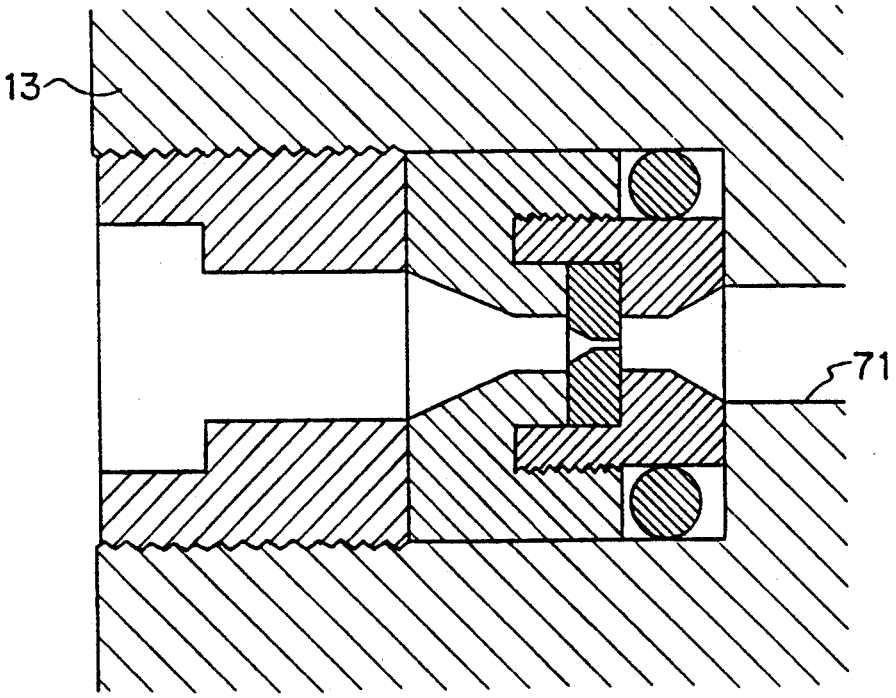
FIG. 7 is a longitudinal sectional view showing the mounting of jet nozzles on the jet gun.

This apparatus will be briefly described with reference to FIG. 4. A follower gear 11 is rotatably disposed within a hollow holder 10A. An eccentric shaft 12 rotatably disposed so that it extends through the follower gear 11 in a position offset from the center of the follower gear 11. A head 13 having seven jetting nozzles 70A to 70G is integrally provided at the tip end of the eccentric shaft 12. The eccentric shaft 12 is communicated with a liquid feeding tube 14 connected thereto so that high pressurized water W can be supplied. On the other hand, although not illustrated, rotary drive means 16 such as motor or air turbine is provided in a grip 15. A primary drive gear 18 is integral with the tip end of an output shaft 17 of the drive means. The primary drive gear 18 is meshed with the follower gear 11. Liquid feeding passages 71 which are communicated with jetting nozzles 70A to 70G are formed in the head 13. The jetting nozzles 70A to 70G are provided in respective branched liquid feeding passages 71 in a manner shown in FIG. 7.

Figure 8:
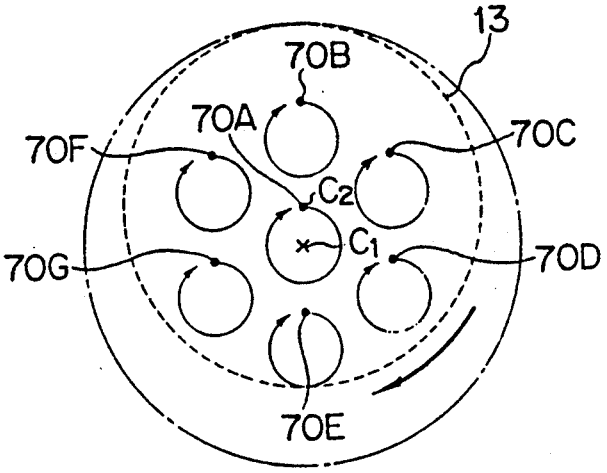
FIG. 8 is an explanatory view showing the motion locuci of the jet nozzles of the jet head.
Figure 9:
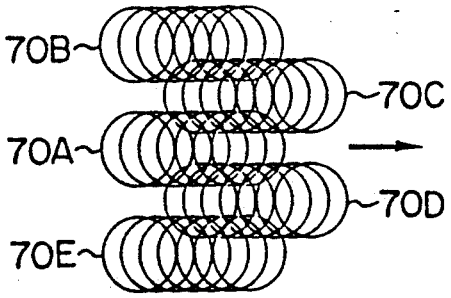
FIG. 9 is an explanatory view showing the motion locuci of the jet nozzles when the head of the jet gun is moved in a horizontal direction.

When the primary drive gear 18 is rotated by rotary drive means 16 while pressurized water is supplied via the liquid feeding tube 14 and the eccentric shaft 12 by using the thus formed jetting gun 1, the follower gear 11 is also rotated. Since the center C2 of the eccentric shaft 12 or the head 13 is offset from the center C1 of the hollow holder 10A at this time, the head 13 eccentrically revolves around the center C1. As a result of this, each of jetting nozzles 70A to 70G traces a circle as shown in FIG. 8. Accordingly, if the jet gun 1 is moved in a lateral direction as shown in FIG. 9, overlapping coverage is provided by the cooperating jet flows.

The traces of the injecting nozzles 70A to 70G are not linear, but overlap in many positions. As a result of this, the jetting energy is applied over the entire of the target surface. Accordingly, if the jet gun is moved in a desired direction while gripping it so that pressurized water is jetted upon the target surface of the paneled stones which are fixed, the entire surfaces of the stones are uniformly roughened.

Figure 10:
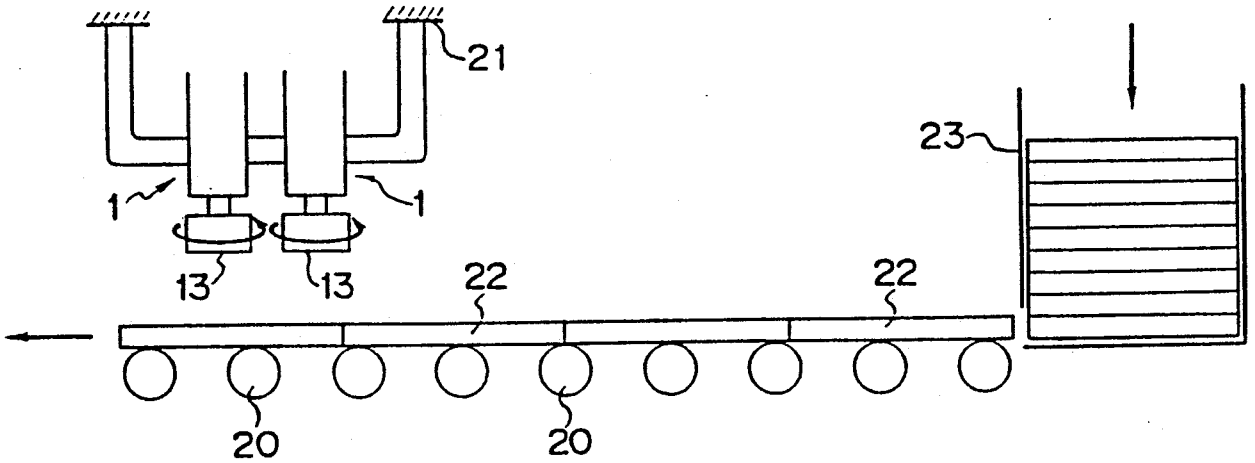
FIG. 10 is a schematic view showing a continuous treating line.
Figure 11:
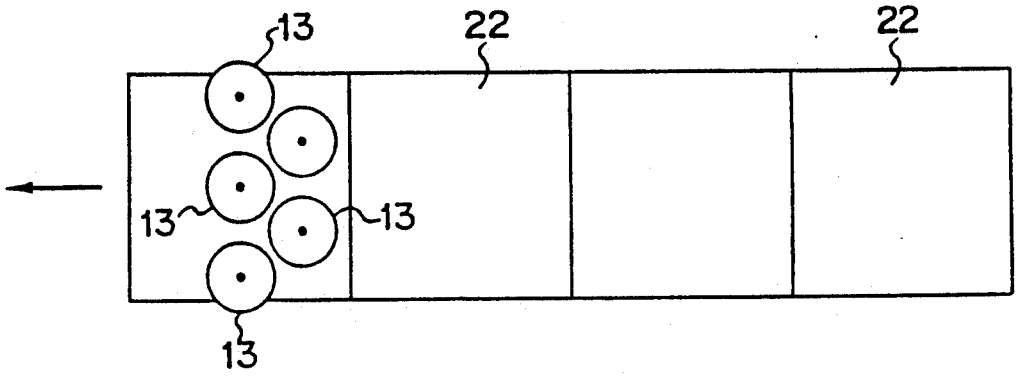
FIG. 11 is a schematic elevational view showing the continuous treating line.
Figure 12:
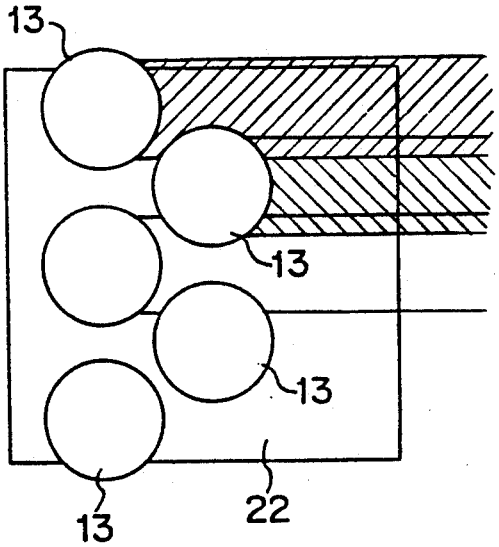
FIG. 12 is an explanatory view of each nozzle head in a treatment area of the continuous treating line.

If a large amount of stone is to be treated, the jet guns 1, 1 . . . may be mounted on a support 21 so that they are travelled across a conveying path comprising a group of conveying rollers 20 and they are disposed above and opposed to the conveying path in a zig-zag manner as shown in FIGS. 10 to 12. Stones 22 which are formed into panels are successively conveyed from a stocker 2 and can be treated by jetted pressurized water jetted from jet guns 1 while they are conveyed in a leftward direction as viewed in FIG. 10 on and along the conveying rollers 20. In this case, in order to prevent occurence of untreated areas on the stones, it is desirable to dispose the heads 13 in a zig-zag manner so that treating areas (hatched) overlap with each other or are not at least separated each other and are adjacent to each other.

Figure 13:
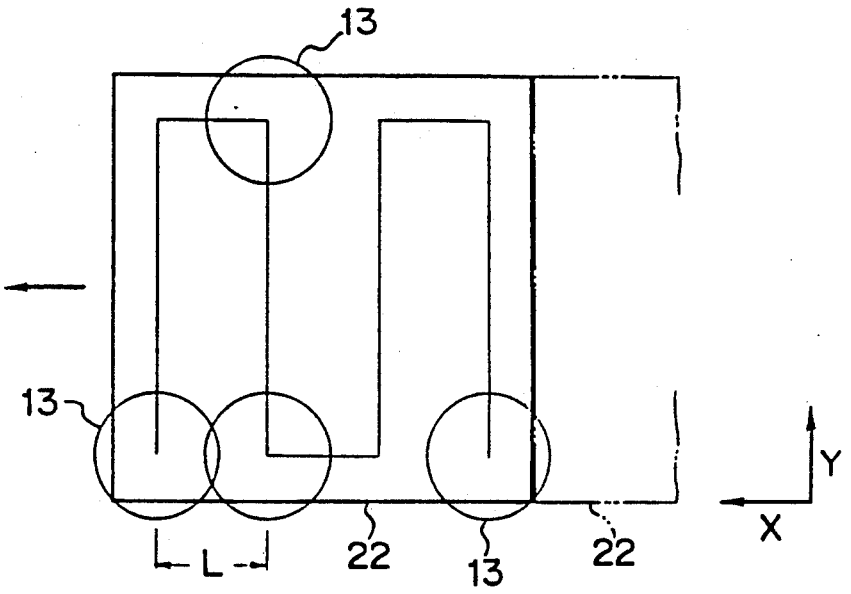
FIG. 13 is an explanatory view showing the motion loci when one nozzle head is moved.

On the other hand, after one panel stone 22 has been treated by moving the head 13 of single jet gun 1 in a crank manner as shown in FIG. 13, the panel stone 22 is moved leftward and the next panel stone 22 which has been held in a right position is moved by its longitudinal length so that this next panel stone can be treated by the jet gun 1 which has been returned to a home position. In this case, both means for moving the jet gun 1 in a width direciton (Y direction) and in a conveying direction (X direction) are necessary. If only the means for moving the jet gun in a width (Y) direction is provided and the panel stone 22 is moved at a pitch L along the conveying path in lieu of providing the means for moving in a conveying direction, the heads 13 are moved along one panel stone 22 in a crank manner as shown in FIG. 13 i.e., in a generally S-shaped continuous movement direction over the entire surface of the panel stone 22.

Figure 14:
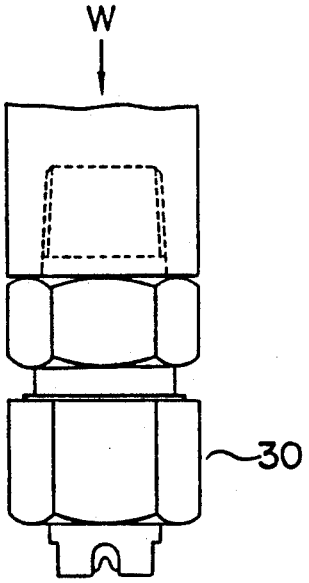
FIG. 14 is a front view showing a fan-shaped jet-forming nozzle.
Figure 15:
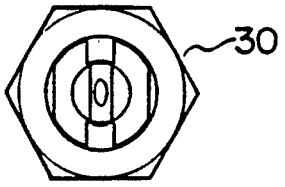
FIG. 15 is a bottom view showing the fan-shaped jet-forming nozzle.
Figure 16:
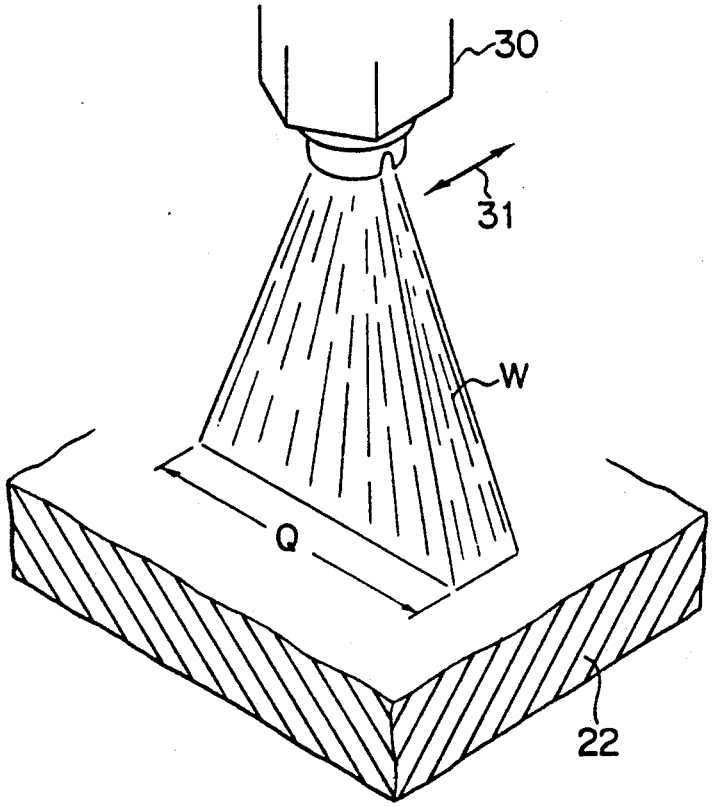
FIG. 16 is a perspective view showing a water jet from the fan-shaped jet-forming nozzle.

In a case in which the jetting nozzle is single or small in number, it is preferable that a so-called fan-shaped jet forming nozzle 30 shown in FIGS. 14 and 15 be used. In this case, it is preferable that the nozzle 30 is moved in a direction normal to the plane of the sector of the fan in a direction represented by a reference numeral 31 as shown in FIG. 16.

If the fan-shaped jet forming nozzle 30 is disposed in the vicinity of the surface of the panel stone 22, the panel stone 22 is treated along a linear line. The surface of the stone 22 can not be very uniformely treated. Accordingly, it is necessary to separate to some extent the nozzle 30 from the surface of the stone 22. If the nozzle 30 is separated from the surface of the stone 22, it is necessary to increase the pressure of water. Accordingly, a high pressure pump is required. Even if the nozzle 30 is separated to some extent from the stone 22, the water jet range in the middle position of the fan sector is different from those in the peripheral positions.

Since the flow rate and flow speed in the peripheral position are inherently lower than those in the middle position due to the structure of the nozzle, the treating capacity is changed in a width direction Q of the sector. As a result of this, the surface of the stone may be often worked in spots. Accordingly, it is preferable to use the above mentioned eccentric rotary head 13. This problem can be overcome to some extent by arranging a plurality of fan-shaped jet forming nozzles 30 so that the sectors of the water jet overlap each other or by arranging the nozzle in a zig-zag manner as shown in FIG. 11.

It is preferable that the jet gun of the present invention has an opening diameter of jetting nozzle of 0.05 to 0.5 mm, a liquid feeding flow rate (the total discharging flow rate) from each jetting nozzle of 1.5 to 12 liters/minute or less and the number of rotation of 800 to 4000 rpm in consideration of reaction when the jet gun is gripped for operation. The flow rate of the liquid may be higher than 12 liters/minute if the gun is provided on the production line of FIG. 10. The pressure of the pressurized water can be furthermore increased by further enlarging the nozzle in dimension.

Figure 19:
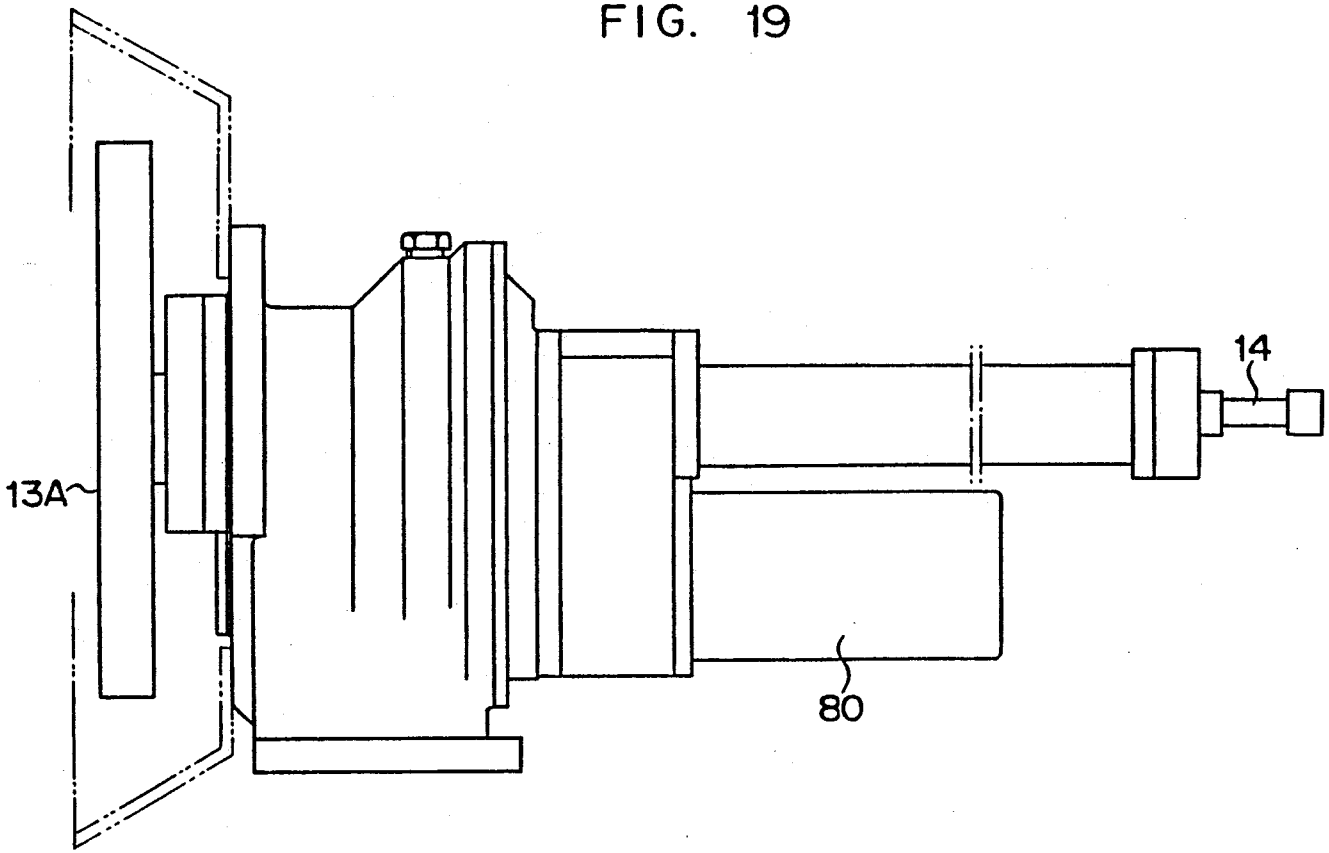
FIG. 19 is a front view showing an alternative working and treating apparatus.
Figure 20:
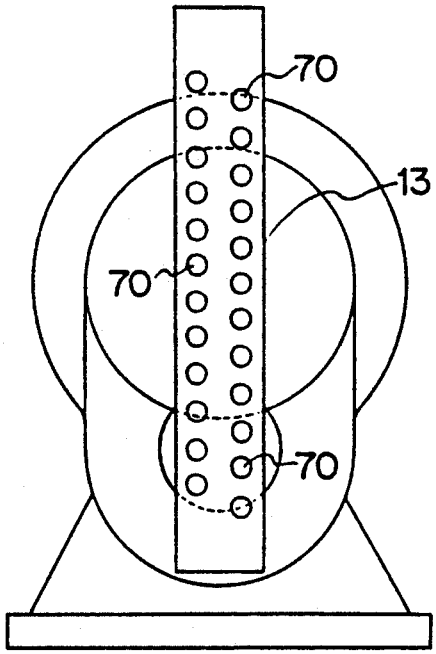
FIG. 20 is a left elevational view showing the apparatus of FIG. 19.
Figure 21:
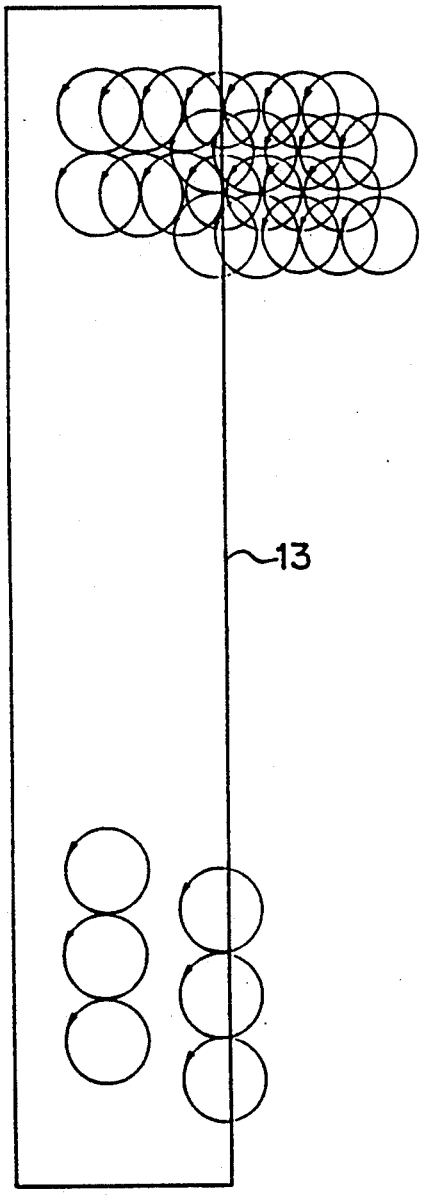
FIG. 21 is an explanatory view showing the moving direction of a nozzle head and the motion locus of the jet nozzle.
Figure 22:
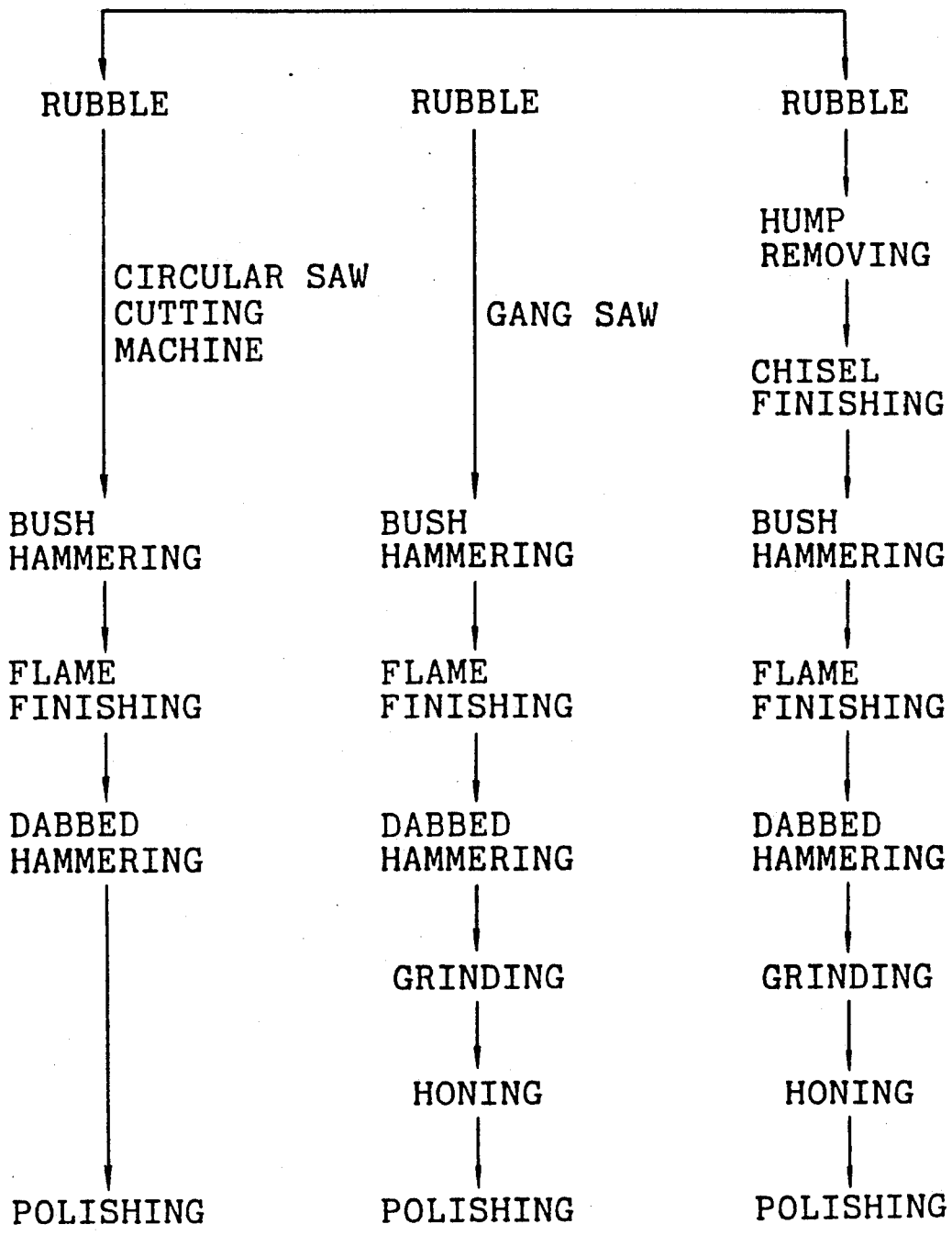
FIG. 22 is a flow chart showing a stone working process.

An example of the apparatus which is suitable for mass treatment is shown in FIGS. 19 to 21. In lieu of the mechanism of FIG. 4, a hydraulic motor 80 is used with a rectangular head 13A. The head 13A is formed with 24 jetting nozzles 70 so that the total discharge rate is 30 to 60 liters/minute. In this case, the longitudinal direction of the nozzle head 13A is aligned with the width direction of the line and the nozzle head 13A is eccentrically rotated by the power transmission mechanism shown in FIG. 4 so that the nozzles 70 trace the motion loci as shown in FIG. 21 for treating the target stone.

Alternatively, treatment can be performed by moving a head having single or plural jetting nozzles to trace curves such as cycloid curve other than linear line or by rocking the head in one direction although not illustrated.

EXAMPLES

Treatment of the surface of the red granite which is cut by a gang saw, the surface cut by a circular saw cutting machine, the bush hammered cut surface, the directly dabbed finished cut surface, the bush hammered, and then dabbed finished surface, the bush hammered and then flamed surface, or the directly flamed surface which is not subjected to bush hammering as shown in FIGS. 4 to 12 provided a surface having excellent concaves and convexes and excellent appearance of natural stone and which never looks whitish.

Treatment of white granite and marble as well as red granite also provided excellent surface as similarly to the former case.

Figure 17:
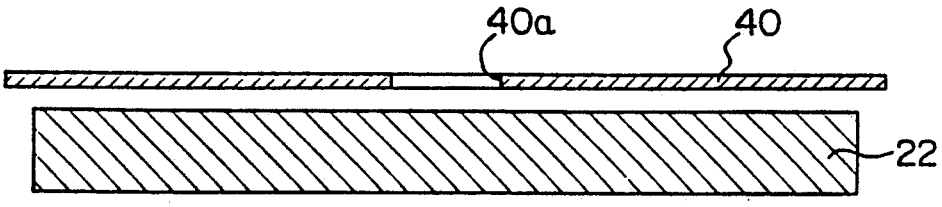
FIG. 17 is a sectional view showing a masking plate which is placed on a stone to be treated.
Figure 18:
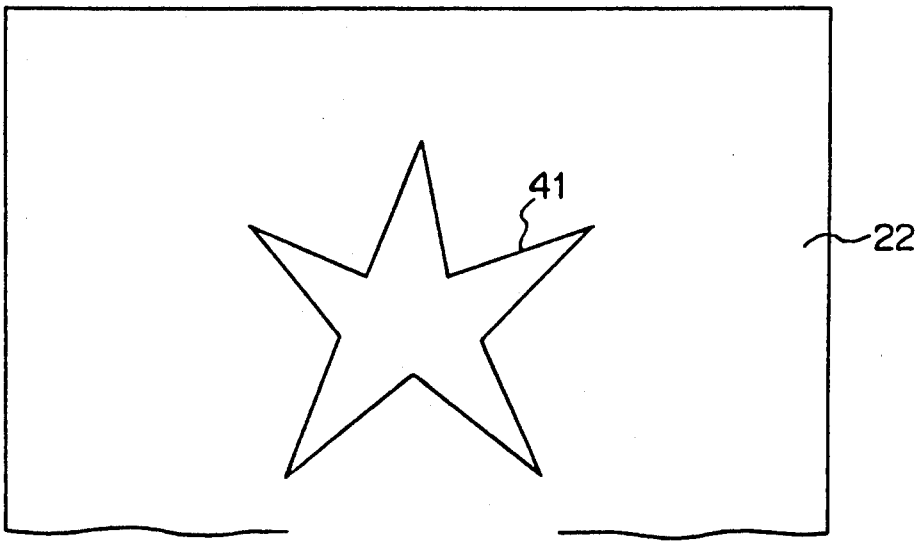
FIG. 18 is a plane view showing an example of a pattern formed when the masking plate is used.

Alternatively, a masking plate 41 made of steel with a through hole 41*a* having a given shape such as star shape was applied on the whitish surface of granite which was cut by a circular saw cutting machine as shown in FIG. 17 and pressurized water was jetted upon the masking plate 41. Resultingly, inherent surface of the red granite appeared in an area corresponding to the through-hole 41*a* as shown in FIG. 18. A pattern which is definite in comparison with the area thereabout was created. Accordingly, the stone can be used as patterning tile.

As mentioned above, the present invention can easily reproduce the natural stone condition and advantageously provides a construction stone having an excellent appearance and concaved and convexed surface, which is suitable for stepping stone.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A method of working and finish-treating a surface of a stone, comprising the steps of:

at least one treatment selected from a group of treatments consisting of gang saw cutting, circular saw cutting, bush hammering, dab finishing, and flaming;

jetting a flow consisting solely of pressurized water directed at the stone surface, at a pressure not less than 200 kg/cm$^2$, through a plurality of nozzles generating jets that respectively overlap adjacent jets;

rotating said plurality of nozzles about a first axis to produce corresponding rotation of respective jets therefrom; and translating said stone surface relative to said rotating jets at a rpedetermined spacing therefrom, said jetted flow thereby removing gangue from the surface to leave a finished stone surface which is close to a natural stone surface.

2. The method according to claim 1, comprising the further step of:

eccentrically rotating said rotating plurality of nozzles about a second axis parallel to said first axis, to thereby obtain a more uniform action by said jetted flow on said previously treated stone surface.

3. The method according to claim 1, wherein:

said jetted flow is provide through said plurality of nozzles each having diameters in the range 0.05 to 0.5 mm, at flow rates per nozzle in the range 1.5 to 12 liters/minute.

4. The method according to claim 2, wherein:

said jetted flow is provided through said plurality of nozzles each having diameters int he range 0.05 to 0.5 mm, at flow rates per nozzle in the range 1.5 to 12 liters/minute.

5. The method according to claim 3, wherein:

said plurality of nozzles is rotated about said first axis at a rotational speed in the range 800–4000 rpm.

6. The method according to claim 4, comprising the further step of:

said plurality of nozzles is rotated about said first axis at a rotational speed in the range 800–4000 rpm.

* * * * *